United States Patent [19]

Jonsson et al.

[11] Patent Number: 4,781,009

[45] Date of Patent: Nov. 1, 1988

[54] STRUCTURAL COMPONENT AND A METHOD AND MACHINE FOR ITS MANUFACTURE

[76] Inventors: Erik A. Jonsson, Box 3411, Yckelsbo, S-82040 Järvsö ; Sven-Erik Fernaeus, Åkervägen 28 B, S-191 40 Sollentuna, both of Sweden

[21] Appl. No.: 30,960

[22] PCT Filed: Jun. 27, 1985

[86] PCT No.: PCT/SE85/00264

§ 371 Date: Feb. 26, 1987

§ 102(e) Date: Feb. 26, 1987

[87] PCT Pub. No.: WO87/00226

PCT Pub. Date: Jan. 15, 1987

[51] Int. Cl.[4] ..... E04C 2/50

[52] U.S. Cl. ..... 52/793; 52/693; 52/309.11; 52/309.7; 144/347; 264/46.5; 264/46.2; 425/122; 425/127

[58] Field of Search ..... 29/155 R, 430; 264/46.3, 46.2, 46.5; 425/817 R, 505, 122, 127, 224, 329; 144/2 R, 347; 52/693, 793, 796, 588, 309.11, 309.7

[56] References Cited

U.S. PATENT DOCUMENTS

| | | | |
|---|---|---|---|
| 3,246,058 | 4/1966 | Voelker | 264/46.2 |
| 3,249,659 | 5/1966 | Voelker | 264/46.2 |
| 3,283,464 | 11/1966 | Litzka | 29/155 |
| 4,441,291 | 4/1984 | Sokoler | 52/588 |
| 4,501,102 | 2/1985 | Knowles | 29/155 |

FOREIGN PATENT DOCUMENTS

| | | | |
|---|---|---|---|
| 614869 | 2/1961 | Canada | 52/588 |
| 2008743 | 11/1971 | Fed. Rep. of Germany | 425/505 |
| 2140077 | 2/1972 | Fed. Rep. of Germany | 52/693 |
| 2334524 | 2/1974 | Fed. Rep. of Germany | 52/693 |
| 9007786 | 7/1945 | France | 52/588 |
| 119101 | 6/1947 | Sweden | 52/793 |

*Primary Examiner*—Henry E. Raduazo
*Attorney, Agent, or Firm*—Sughrue, Mion, Zinn, Macpeak and Seas

[57] ABSTRACT

A method for manufacturing an elongated, box-like structural component comprising two mutually opposing side-members (1, 2) which define a cavity therebetween. The mutually opposing surfaces of the side-members present longitudinally extending grooves into which projections on distance pieces (3) located between the members engage. In the process of manufacturing the structural component pairs of boards or the like are advanced in spaced relationship in the longitudinal direction of the boards into a receiving station (7) with the grooved inner surfaces of the boards facing one another, the distance pieces (3) being placing between the boards as they enter the station (7). As the boards leave the station, they are pressed towards one another in a manner to bring the projections on the distance pieces (3) into engagement with the grooves on the inwardly facing surfaces of the boards. The invention also relates to a machine for use when carrying out the method, and to a structural component manufactured in accordance with the method.

10 Claims, 3 Drawing Sheets

STRUCTURAL COMPONENT AND A METHOD AND MACHINE FOR ITS MANUFACTURE

In the art of building materials there is known a structural component intended for wall structures which comprises an elongated box-like element having two mutually opposing side members which define a cavity therebetween and the mutually facing inner surfaces of which present longitudinally extending grooves, and between which side members there are located distance pieces having projections which engage in the grooves.

In the manufacture of structural components of this kind it has been necessary to employ hitherto methods which can be described more or less as handicraft methods, which has made manufacture a slow and expensive process.

One object of the present invention is to provide a method and a machine for enabling the continuous manufacture of such structural components in a rational fashion.

The method and machine according to the invention can also be utilized to manufacture a further development of the aforesaid structural component intended for wall structures, this modified structural component being suitable for use as a self-supporting floor component and the like.

Consequently, a further object of the invention is to provide a structural component of the aforedescribed kind which is capable of being used as a component in floor structures.

One advantage afforded by a structural component of the aforesaid kind is that the component obtains and retains its final form immediately the plate-like distance pieces are brought into engagement with the side members of the component. This advantage is utilized in the method of the manufacture according to the invention, which enables such a structural component to be produced continuously in indefinite lengths, and then cut into required lengths.

The method according to the invention for manufacturing a structural component of the aforesaid kind is particularly characterized by advancing longitudinally to a receiving station pairs of mutually spaced boards or the like which are operative in forming the side members of the component and which have grooves provided in the mutually facing surfaces thereof; by placing and supporting the plate-like distance pieces on an endless belt extending in the longitudinal direction of the boards and moving said belt at a speed corresponding to the speed at which said boards are advanced; by bringing the distance pieces between the boards of an incoming pair of boards; and by pressing the boards towards one another as they leave the station, so as to bring the projections on the distance pieces into engagement with the grooves in the inwardly facing surfaces of the boards.

In this regard the distance pieces are preferably supported by supporting means mounted on the belt and projecting in between the boards.

When manufacturing insulated structural components, insulating foam can be ejected continuously into the aforesaid cavity as the building structural component leaves the station for fitting of the aforesaid distance pieces, these distance pieces separating the cavity into a plurality of separate compartments, wherewith the normally open sides of the cavity are held closed with the aid of belts or bands which extend along and are pressed against the edge surfaces of the side members of the component under construction.

The particular characteristic features of a machine for manufacturing a structural component when using this method are set forth in the following claims The aforementioned further development of the structural component described in the introduction for use as a self-supporting floor component or the like, where the side members of the structural component respectively form the top and bottom surfaces of the floor structure, is characterized in that each of the side members is provided with an upwardly facing groove which extends along one longitudinal side edge of the structural component, and with a correspondingly downwardly depending tongue along the other longitudinal side edge of the component. A tongue and groove joint of this construction, formed at right angles to the plane of the boards, enables the floor components to be joined together readily and simply and also provides a more rigid floor of greater bearing capacity than that obtained when joining the boards together through the agency of conventional tongue and groove joints located in the plane of the boards.

The floor component is also suitably filled with insulating foam, and can be further reinforced by introducing stiffeners between the plate-like distance pieces.

In accordance with one embodiment, which facilitates, inter alia, laying of the floor components, the top side member is displaced laterally in relation to the bottom side member.

The invention will now be described in more detail with reference to the accompanying drawings, in which FIG. 1 illustrates in perspective the manner of laying a floor component according to the invention;

Figure 1:
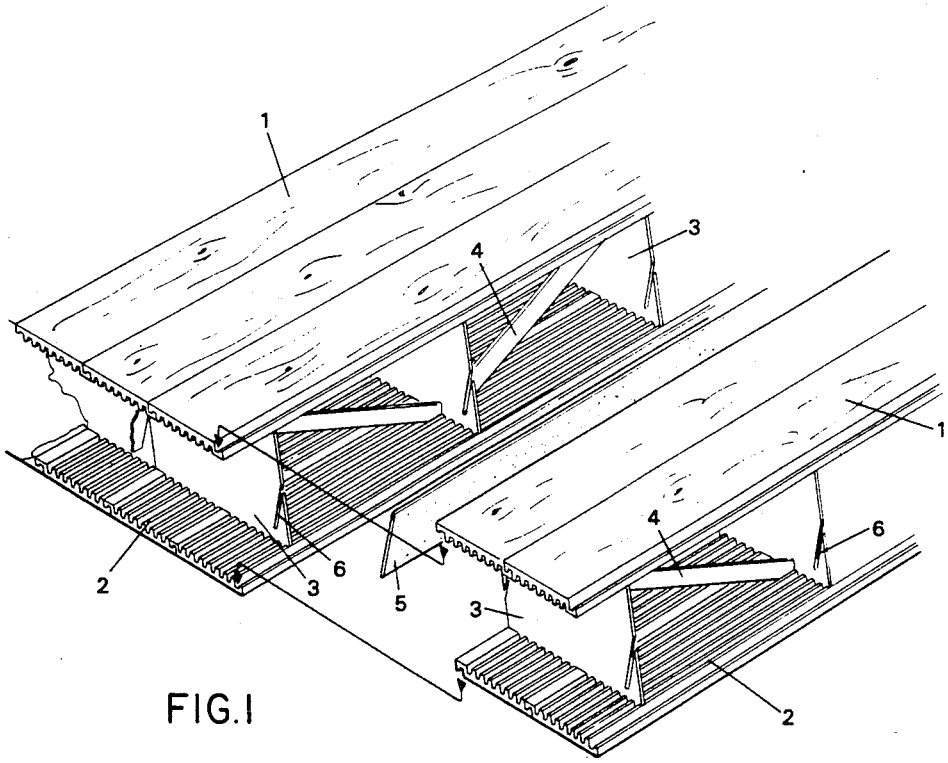
Figure 2:
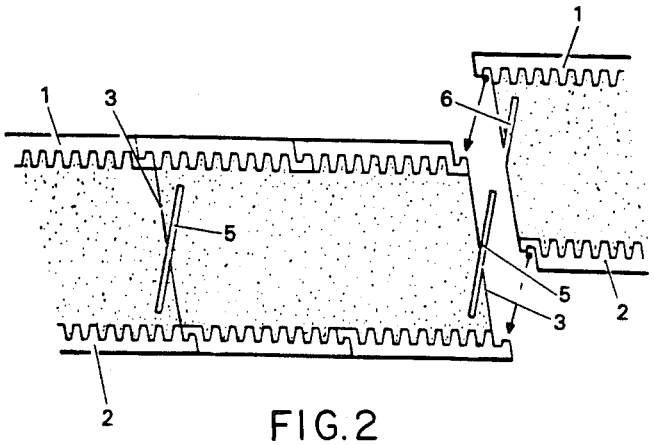
FIG. 2 is an end view corresponding to FIG. 1.

As illustrated in FIGS. 1 and 2, a floor component according to the invention comprises a top side-member 1 and a bottom side-member 2, each of which comprises in this example two mutually joined boards. In a manner known per se each of the side-members 1 and 2 has extending along the inwardly facing surfaces thereof a plurality of longitudinal grooves, and the boards are mutually joined together in a known manner by distance pieces 3 which engage in the grooves and divide the cavity defined by said side members into separate compartments. The structural component can be stiffened with the aid of braces 4 or like elements arranged to join mutually adjacent distance pieces 3. The cavity defined by the side members and divided into separate compartments by the distance pieces is suitably filled with insulating foam.

The braces 4 may be replaced with other devices, for example with wood-fibre strips which extend in the longitudinal direction of the boards and engage opposing grooves therein. These strips are conveniently perforated, to enable foam to fill the cavity between the boards completely. The use of stiffening strips arranged in the aforesaid manner greatly enhances the supporting capacity of the floor structure.

A floor component constructed in this way is extremely rigid, due inter alia to the distance pieces 3, which are suitably spaced apart at distances of about 30 cm. The braces 4, or the alternative stiffening strips, also contribute to the high degree of rigidity of the floor component, as does also the foam insulation when present. In order to improve the bearing capacity of a floor constructed from floor components according to the invention still further, however, mutually adjacent components are joined together by means of a novel tongue and groove joint.

Conventional tongue and groove joints include a groove and corresponding tongue which both extends in the plane of the associated boards. In order to improve the joint between mutually adjacent floor component in the illustrated application, however, the tongue and groove joint is effected by means of tongues and grooves which form angles of substantially 90° with the plane of associated boards. To this end, a groove is provided along each of the side members 1 and 2 on one side of the structural member, said grooves both facing in mutually the same direction, while mutually oppositely directed tongues are provided along the other side of the structural member. This enables one floor component according to the invention to be readily hooked firmly to an adjacent floor component, in the manner illustrated, thereby stiffening the floor structure as a whole and eliminating the possible presence of seasoning cracks between the floor components. This together with the latching effect on the wood in the side-members 1 and 2 afforded by the distance pieces 3 enables a floor to be constructed from structural components according to the invention with which there is a minimum risk of crack formation or movements between the individual boards.

In order to further improve the joint between mutually adjacent floor components and the rigidity of the transition region, an elongated strip-like element 5, for example a wood-fibre strip, can be inserted in slots 6 in the side edges of the distance pieces 3, as illustrated in FIGS. 1 and 2. In order to improve the stiffening effect of the strip-like elements 5 and to facilitate laying of the floor components, the top and bottom side members 1 and 2 of the illustrated embodiment are displaced laterally in relation to one another. This is not an essential feature of the invention, however, and elements of purely elongated rectangular cross-section can be manufactured. The use of inclined components, however, improves among other things the seal between mutually adjacent, foam-filled components.

Figure 3:
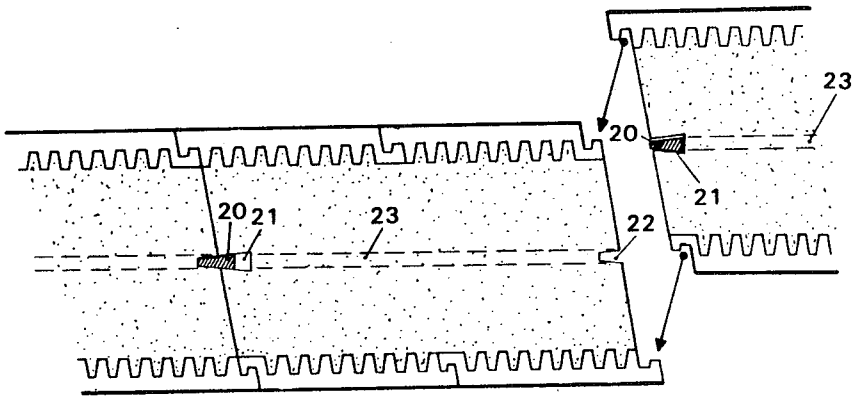
FIG. 3 is a corresponding end view illustrating a modified embodiment of the floor component.

FIG. 3 illustrates an alternative method of producing a stiffening joint between mutually adjacent floor components this alternative method simplifying manufacture of the floor components and the laying thereof. Instead of the obliquely fitted strip-like element of FIGS. 1 and 2 there is used in the FIG. 3 embodiment horizontal, suitably slightly wedge-shaped elements 20, which can be inserted from one end of each floor component into a horizontal groove 21 extending along one longitudinal side of the floor component. The groove 21 has a wedge-shaped cross-section corresponding to that of the strip-like element 20, but slightly larger dimensions than said element. The reference 22 identifies a wedge-shaped groove which corresponds to the strip-like element 20 and which extends along the other longitudinal side of each floor component, and the reference 23 identifies a plurality of transverse holes disposed along the length of said element.

In this embodiment mutually adjacent floor components can be joined together by pressing the strip-like element carried by one floor component into a corresponding groove 22 located in an adjacent floor component, with the aid of a lever or some other suitable tool. The strip-like element 20 will therewith tightly conform to the defining surfaces of the grooves 21 and 22.

Because the boards are effectively held together in correct positions relative to one another with the aid of the distance pieces 3, a structural component according to the invention can be produced in a continuous process. A method and a machine herefor will now be described with reference to FIG. 4. The machine illustrated schematically therein is intended for the manufacture of structural components of purely elongated rectangular cross-section, for example for wall structures, but can be readily modified for manufacturing the structural components illustrated in FIGS. 1 and 2.

Figure 4:
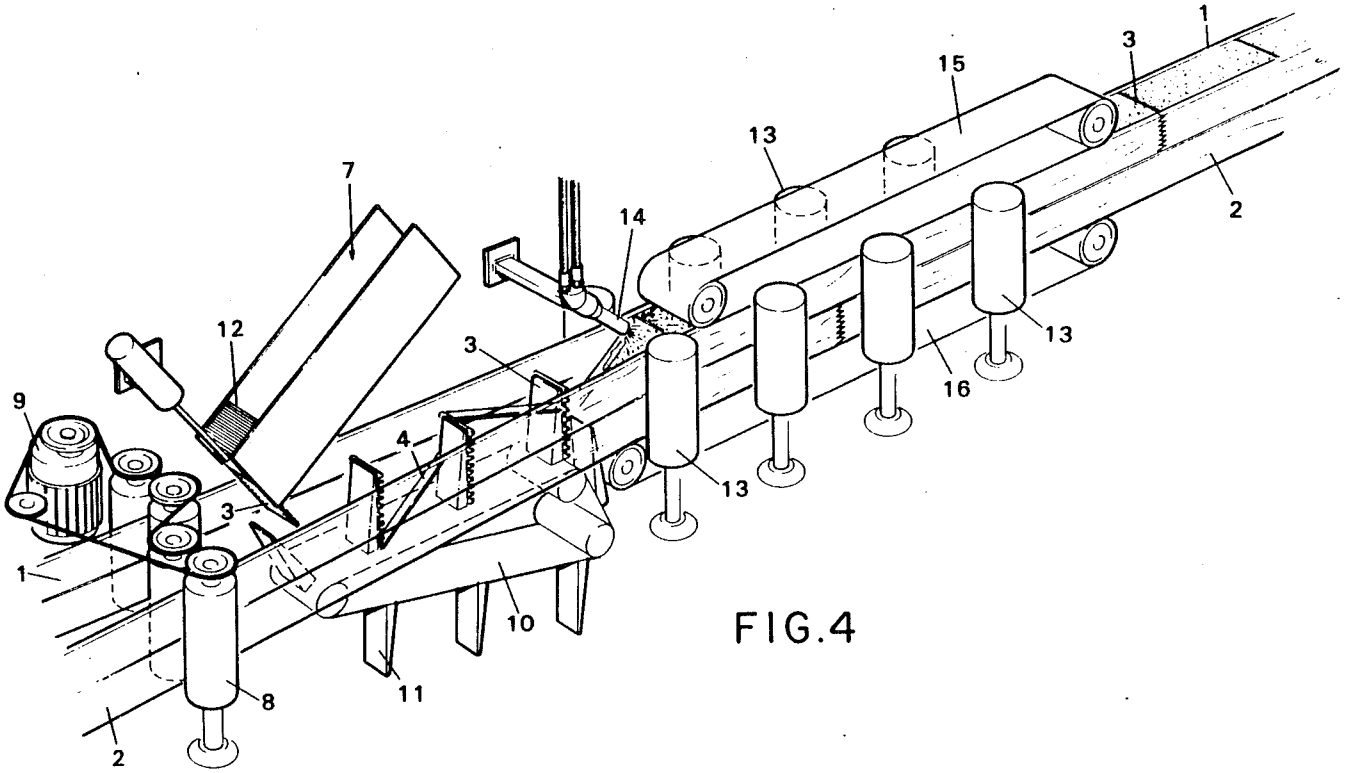
FIG. 4 illustrates schematically the principle construction of a machine for producing box-like structural components.

When practising the embodiment of the. invention illustrated in FIG. 4, the two side-members 1 and 2 of the structural component are guided into a station 7 by means of rollers 8, which are driven by a motor 9. Distance pieces 3 are positioned between the incoming pair of side-members 1 and 2 in the station 7, with the aid of an endless belt 10 having supports 11 for supporting the distance pieces 3, which are fed from a magazine 12. When braces 4 are required, these braces are placed between the distance elements 3 in the station 7. The means required for positioning the distance pieces 3 and the braces 4 can be of any desired construction. The only necessity in this respect is to ensure that the distance pieces 3 are held correctly in position between the side-members 1 and 2 when the side-members are pressed towards one another by means of the illustrated outer rollers 13, as the side-members leave the station 7.

The projections on the distance pieces 3 intended for engagement with respective grooves in the side-members 1 and 2 are coated with glue prior to positioning the distance pieces between the side-members, which are firmly fixed relative to one another immediately they are pressed into engagement with the distance pieces, inter alia as a result of the friction between projections and grooves. Among other things it is this which enables the structural component to be manufactured in a continuous process, since said component need not be held under pressure in a stationary press device.

The individual boards forming the side-members can be joined end to end with one another as they are held fixed relative to one another by the tongue and groove joint between the two boards of each side-member, and by the distance pieces 3. Because the structural component according to the invention can be manufactured in a continuous running length, unnecessary wastage is avoided both when manufacturing the structural component, since whole board lengths can be used, and in the latter use of said component, since components of suitable lengths for the use in question can be pre-cut from a single long length. The design of the structural component also enables it to be readily filled with insulating foam in conjunction with the manufacture of the component. To this end there is arranged a foam-filling nozzle 14 at that position in the machine where the side-members 1 and 2 are pressed into engagement with the distance pieces 3. Foaming of the insulating substance takes place in the cavity presented between the side-members 1 and 2 and divided into separate compartments by the distance pieces 3. The pressure in the cavity increases considerably during foaming of the insulation, and is taken up laterally by the rollers 13. The normally open sides of the structural component are held closed along that part of the machine at which foaming takes place, by means of an upper and a lower endless steel belt 15 and 16, which accompanies the movement of the structural component and is pressed sealingly against the side edges of the side-members 1 and 2 thereof. To this end there are used on the rear sides of the belts 15 and 16 counter-pressure devices (not shown) having a low-friction slide surface facing towards respective belts.

The ease with which the structural component can be filled with foam is due to the distance pieces 3, which function as throttles. Without the presence of sealing distance pieces, the foam mass would be pressed out of the cavity in a direction towards the station 7. The distance pieces 3, however, form together with the belts 15 and 16 and the side-members 1 and 2 closed chambers which enclose the foam.

The fact that the structural component can be filled with foam during the process of manufacturing the component affords several advantages, among which can be included a significantly more effective and more readily controlled filling of the component with foam and more rational construction, since it is no longer necessary to fill the structural component with foam insulation in a separate working stage on the working site. In addition hereto, a foam-filled structural component according to the invention is completely straight, and will not subsequently change shape as a result, inter alia, of the barrier action of the foam.

The aforedescribed machine can be modified in various respects within the scope of the following claims, while retaining the advantages of continuous and rational manufacture of a structural component, with simultaneous filling of the component with foam insulation. This applies, for example, to both the station 7 for mounting the distance pieces, and the arrangement for sealing the aforesaid cavity when filling the compartmental cavities between the distance pieces with foam.

We claim:

1. A method for manufacturing an elongated, box-like structural component, comprising two mutually opposing side-members which define a cavity therebetween and the mutually inner surfaces of which present longitudinally extending grooves, and between which side-members there are located distance pieces having projections which engage in respective grooves, said method comprising advancing longitudinally to a station pairs of mutually spaced boards or the like serving to form the side-members of the structural component and having grooves provided in the mutually facing surfaces thereof, the method being characterized by the further steps of placing and supporting the plate-like distance pieces (3) on an endless belt (10) extending in the longitudinal direction of the boards, such as to position the distance pieces between said boards in said station, said belt (10) being moved at a speed corresponding to the speed at which said boards are advanced; and by pressing the boards towards one another as they leave the station, so as to bring the projections of the distance pieces into engagement with respective grooves in the inwardly facing surfaces of the boards.

2. A method according to claim 1, characterized by supporting the distance pieces on the belt with the aid of support means projecting in between the boards.

3. A method according to claim 1 or claim 2, characterized by placing the distance pieces between the boards from a magazine located on the opposite side of the pair of boards in relation to said belt.

4. A machine for manufacturing an elongated, box-like structural component comprising two mutually opposing side-members (1,2) which define a cavity therebetween and the mutually facing inner surfaces of which present longitudinally extending grooves, and between which side-members there are located distance pieces (3) having projections which engage in respective grooves, and which machine comprises means (8,9) for advancing longitudinally to a station (7) pairs of mutually spaced boards or the like serving to form the side-members (1,2) of the structural component with the grooved surfaces of the boards facing one another, said station incorporating means for positioning the distance pieces between a pair of incoming boards, characterized in that said station (7) includes a magazine (12) for storing distance pieces (3), and an endless belt (10) which moves in the longitudinal direction of the pair of boards and which provides support for distance pieces fed from the magazine, said belt (10) being driven at a speed corresponding to the speed at which the boards are advanced, and means (13) for pressing the boards towards one another in a manner to cause the projections on the distance pieces (3) to engage in respective grooves on the inwardly facing surfaces of the boards as the pair of boards leaves said station.

5. A machine according to claim 4, characterized in that the belt (10) is provided with support means (11) intended for supporting the distance pieces (3) and extending in between the boards.

6. A machine according to claim 4 or claim 5, characterized in that the magazine (12) is located on the opposite side of the pair of boards relative to the belt (10).

7. A machine according to any one of claims 4 or 5, intended for manufacturing insulated structural components characterized in that the machine further includes at least one nozzle (14) for injecting insulating foam into the cavity defined by the side-members, said cavity being divided into separate compartments by the distance pieces, and belts or bands (15,16) which are intended to seal-off the normally open sides of the cavity and which accompany the movement of the structural component and are pressed sealingly against the edges of the side-members (1,2) thereof.

8. An elongated, box-like structural component intended for use as a self-supporting floor component or the like comprising two mutually opposing side-members (1,2) which includes a top side member and a bottom side member and define a cavity therebetween and the mutually facing inner surfaces of which present longitudinally extending grooves, and between which side-members there are located distance pieces (3) having projections which engage respective grooves, said side-members (1,2) being intended to form the top and the bottom surfaces respectively of the floor structure, characterized in that each of said side-members (1,2) is provided with an upwardly facing groove along one longitudinal side edge of the structural component, and with a corresponding, downwardly depending tongue along the other longitudinal side edge of said component.

9. A structural component according to claim 8, characterized in that stiffening means (4) are arranged between the distance pieces (3).

10. A structural component according to any one of claims 8 or 9, charaterized in that the top side member (1) is displaced laterally in relation to the bottom side member (2).

* * * * *